US005735204A

United States Patent [19]

Hara et al.

[11] Patent Number: 5,735,204

[45] Date of Patent: Apr. 7, 1998

[54] DAMPENING WATER CIRCULATION SYSTEM FOR OFFSET PRESS

[76] Inventors: Akira Hara, Room No. 10, Fung Full Commercial Centre, 480 Kings Road, North Point, Hong Kong; Hiraku Onuma, 18-3-2-50, Utsukushiga-Oka 1-chome, Midori-ku, Yokohama-shi Kanagawa, Japan

[21] Appl. No.: 924,403

[22] Filed: Aug. 22, 1997

Related U.S. Application Data

[63] Continuation of Ser. No. 285,976, Aug. 4, 1994, abandoned.

[30] Foreign Application Priority Data

Aug. 11, 1993 [JP] Japan ..... 5-219130
Oct. 29, 1993 [JP] Japan ..... 5-294501

[51] Int. Cl.[6] ..... B41F 7/32; B41F 7/26

[52] U.S. Cl. ..... 101/148

[58] Field of Search ..... 101/148, 147, 101/208, 209–210, 350.1, 350.2, 350.5, 364, 366, DIG. 45; 118/259, 261

[56] References Cited

U.S. PATENT DOCUMENTS 3,769,909 11/1973 Fugman et al. .
4,211,167 7/1980 Corse ..... 101/148
5,357,864 10/1994 Ohta et al. ..... 101/148

FOREIGN PATENT DOCUMENTS

A-0371386 6/1990 European Pat. Off. .
A-0517462 12/1992 European Pat. Off. .
A-2128370 10/1972 France .
A-22 03 046 8/1973 Germany .
A-05069528 3/1993 Japan .
A-383413 1/1965 Switzerland .

OTHER PUBLICATIONS

European Search Report of Nov. 21, 1994 by E. Thibaut.

Patent Abstract of Japan, vol. 17, No. 385 (M–1448), Jul. 20, 1993, Japan.

*Primary Examiner*—J. Reed Fisher
*Attorney, Agent, or Firm*—Morgan & Finnegan, L.L.P.

[57] ABSTRACT

A dampening water circulation system achieves further lightweighting, easy maintenance and decreases a heat energy influencing the temperature of the dampening water. There are provide a dampening water supply pipe 50 and the dampening water pool bar 60 along the water fountain roller 20. The dampening water pool bar and the water fountain roller are arranged to maintain an aperture G of several mm to thereby form the water pool portion 70 between two members. The fed water can be kept in the dampening water pool portion to be applied on the water fountain roller. The dampening water pool portion is made small in size to minimize a time for the dampening water from the supply pipe 50 to the water fountain roller whereat the supplied water does not influenced by any foreign element, which can minimize the return water amount and is effective to decrease the cooling capacity for the used dampening water.

10 Claims, 15 Drawing Sheets

DAMPENING WATER CIRCULATION SYSTEM FOR OFFSET PRESS

This is a continuation of application Ser. No. 08/285,976, filed on Aug. 4, 1994, now abandoned.

BACKGROUND OF THE INVENTION

1. Field of the Invention

This invention is broadly concerned with a dampening water circulation system used in an offset press and intended particularly to be used to a dampening water circulation system which minimizes foreign elements for the dampening water and forms uniformed water screen on form plates preferably with small water.

2. Description of the Related Art

There are some known conventional dampening water circulation systems for the general offset press, for examples, a system wherein a ductor is adapted to intermittently contact with a water fountain roller constantly dipped in water stored in a water fountain, a system wherein a damping roller is constantly rotatably contacted with the water fountain roller, a system wherein the dampening water is fed to the damping roller by rotatably contacting a rotary brush with the water fountain roller in a sate there is a gap of rotational speeds between them, and a system wherein the dampening water is sprayed over the water fountain roller.

One of the conventional dampening water circulation systems will be explained in detail with reference to FIG. 23. The dampening water circulation system is essentially consisting of a dampening roller apparatus 2 to transmit the dampening water to form plates 1 of an offset press (hereinafter referred to as "press") and a dampening water circulating device 3 to control the dampening water fed to the dampening roller apparatus 2. The dampening roller apparatus 2 has a water fountain roller 20 finished thereon with chromium coating to have hydrophilic nature, a rubber roller 22 and a chromium roller 24 in serial contact with each other in this order. The chromium roller 24 is arranged to be in serial contact with a rubber damping roller 26 whereat these serial rollers are relatively rotated to transmit the dampening water to the form plate 1. The dampening water circulating device 3 is provided to store therein a predetermined amount of dampening water constantly for the water fountain roller and further control amount, temperature and quality of the dampening water returned from a water fountain 30.

Such dampening water circulation system has already taught in the Japanese Utility Model Application Publication No. Hei 4-43321.

FIG. 24 is a schematical view depicting a spray type, wherein a spray nozzle 40 is disposed to oppose to a chromium roller 24 contacting with the dampening roller 26 to thereby spray the dampening water fed from a dampening water supply 4 by means of a spray nozzle 40.

As has been mentioned above, in such conventional system, the water fountain roller is constantly soaked in the dampening water stored enough in the water fountain to transmit the dampening water to the following rollers. The surplus dampening water in the water fountain may cause a clogging state of a pipe extending from the water fountain because of ink and link adhered to the water fountain roller. It is therefore required for the dampening water circulating device to improve its function to remove such stains from the dampening water and cool down. In the spray system without the water fountain and the water fountain roller, it is difficult to apply the dampening water on the roller with a microscopic order and the maintenance for preventing clogging is a time-consuming job or costly.

It is an object of the present invention to provide a dampening water circulation system which achieves further lightweighting and reduced cost and to complete its maintenance easily.

Another object is to provide a dampening water circulation system in which an arrangement of the dampening rollers are easily modified to thereby minimize the space for their installation.

SUMMARY OF THE INVENTION

In order to obtain the above objects, the present invention is conceived to provide a dampening water circulation system for an offset press wherein a dampening water fed through a dampening water supply line is transmitted on a form plate via a dampening roller consisting of a water fountain roller and plural ductors arranged serially, the dampening water circulation system, have: a dampening water supply member connected with the dampening water supply line and oppositely aligned with an axis of one of the dampening roller; a dampening water pool bar arranged parallel to the dampening roller to form a water pool portion keeping therein the dampening water fed from the dampening water supply member in combination with the water fountain roller or a roller disposed adjacent to the water fountain roller; and a return dampening water receiving member to collect therein the dampening water which does not transmitted from the water fountain roller to the ductor.

The following elements are also characteristic in the present invention.

(1) A plurality of dampening water pool bar around the water fountain roller.

(2) The rotatable dampening water poll bar.

(3) The return dampening water receiving member has a convergent taper inside thereof, a gathered point of the convergent taper being opened.

The invention in accordance with one embodiment is characterized to further have a dampening water feed amount control assembly to regulate feeding amount of the dampening water fed from said dampening water supply member in accordance with required quantity of water for the form plate.

The following elements are also characteristic in the above mentioned embodiment.

(1) The dampening water feed amount control assembly is adapted to have a dampening water gain function to promptly supply an additional dampening water to keep a standard amount of the dampening water in the water pool portion.

(2) A feeding amount control of the dampening water by means of a sensor detecting an amount at the water pool portion or of the return dampening water.

(3) A feeding amount control of the dampening water by means of a sensor detecting a printing speed.

One embodiment of the present invention is a dampening water circulation system for an offset press wherein a dampening water fed through a dampening water supply line is transmitted on a form plate via a dampening roller consisting of a water fountain roller and plural ductors arranged serially, the dampening water circulation system, has: a dampening water supply member connected with the dampening water supply line and oppositely aligned with an axis of one of the dampening roller to keep the dampening water flown out therefrom; and a return dampening water receiving member to collect therein the dampening water which does not transmitted from the water fountain roller to the ductor.

Another embodiment is a dampening water circulation system for an offset press wherein a dampening water fed through a dampening water supply line is transmitted on a form plate via a dampening roller consisting of a water fountain roller and plural ductors arranged serially, the dampening water circulation system, has: a dampening water supply member connected with the dampening water supply line and oppositely aligned with an axis of one of the dampening roller to pour the dampening water therefrom; a lead plate arranged parallel to the dampening roller to guide the dampening water toward the water fountain roller or the roller adjacent to the water fountain roller; and a return dampening water receiving member to collect therein the dampening water which does not transmitted from the water fountain roller to the ductor.

This embodiment is further characterized by the following limitations.

(1) The lead plate made of an elastic materials, the lead plate being disposed such that a forward end thereof is kept contact with the water fountain roller or the roller adjacent to the water fountain roller.

(2) The lead plate shaped such that a water pool portion is formed between the water fountain roller or the roller adjacent to the water fountain roller.

(3) The lead plate formed to include a water pool portion near the water fountain roller or the roller adjacent to the water fountain roller, so that the dampening water flown over the water pool portion is applied to the water fountain roller or the roller adjacent to the water fountain roller.

(4) The lead plate and the return dampening water receiving member are integrally provided.

In accordance with another embodiment, the dampening water fed from the dampening water supply member-is kept in combination with one or more dampening water pool bars and the roller at the water pool portion from which the water fountain roller receives the necessary water. The not-transmitted water can be collected by the return dampening water receiving member and then forward the dampening water regulation device via the return pipe. The water pool portion is made minimum in size to keep necessary amount of water, so that the dampening water fed out from the dampening water supply member can reach to the water fountain roller in a short period of time, which may not bring the fed water into unfavorable state because of any foreign element, so that there is no necessary to improve a cooling capacity.

In accordance with another embodiment, the feed amount of the dampening water by the dampening water supply member is controlled based on the amount of water in the water pool portion, the returned quantity of the dampening water or the printing speed, which is effective 16 save unnecessary dampening water.

In accordance with yet another embodiment, the water pool portion is formed between the dampening water supply member and the water fountain roller, so that the number of parts can be small to obtain the same objects and operation as mentioned before.

In accordance with a further embodiment, the same objects and operation can be obtained by spreading the dampening water fed from the dampening water supply member on the lead plate while flowing down and then supplying directly on the water fountain roller or by feeding to the water fountain roller via the water pool portion provided at a forward end portion on the lead plate or between the lead plate and the water fountain roller.

BRIEF DESCRIPTION OF THE DRAWINGS

FIG. 20 is a schematical view depicting a lead plate having a relief hole therein to allow overflow water pass through;

DETAILED DESCRIPTION OF THE PREFERRED EMBODIMENT(S)

Figure 1:
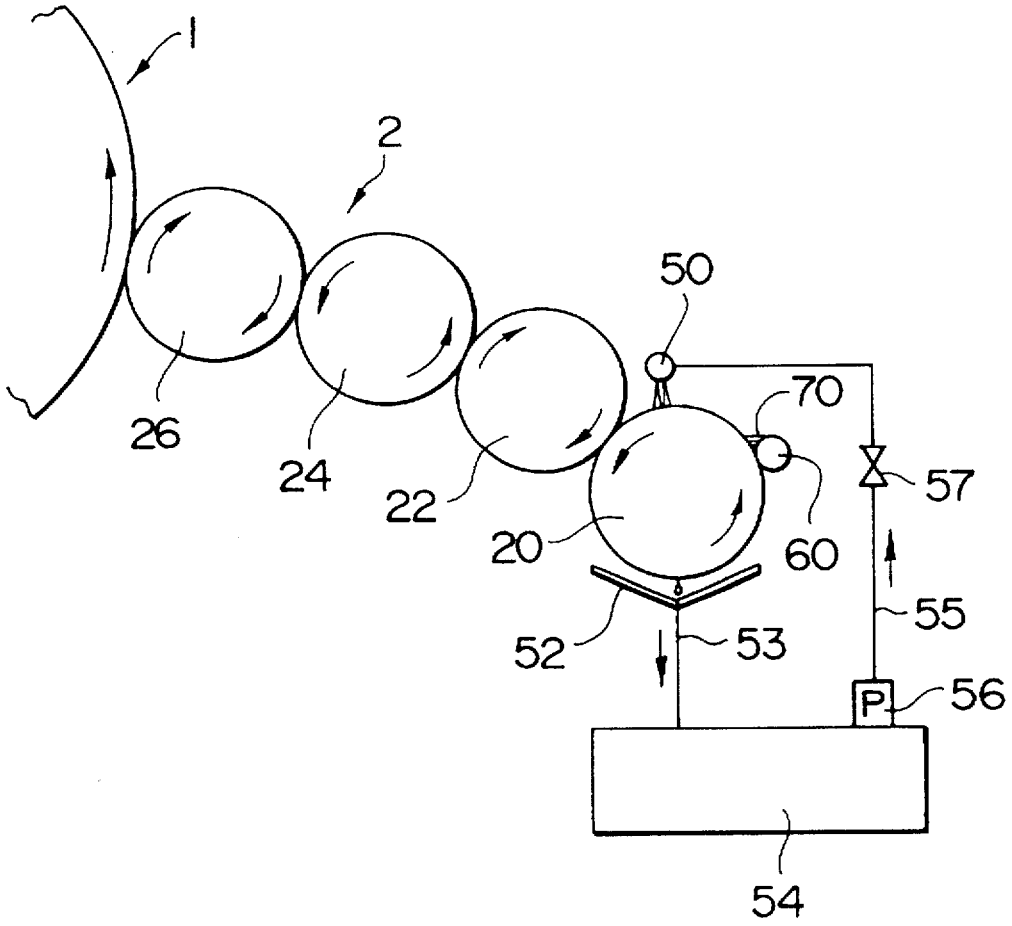
FIG. 1 is a diagrammatic view depicting the appearance of the overall composition of a dampening water circulation system in accordance with the present invention.
Figure 23:
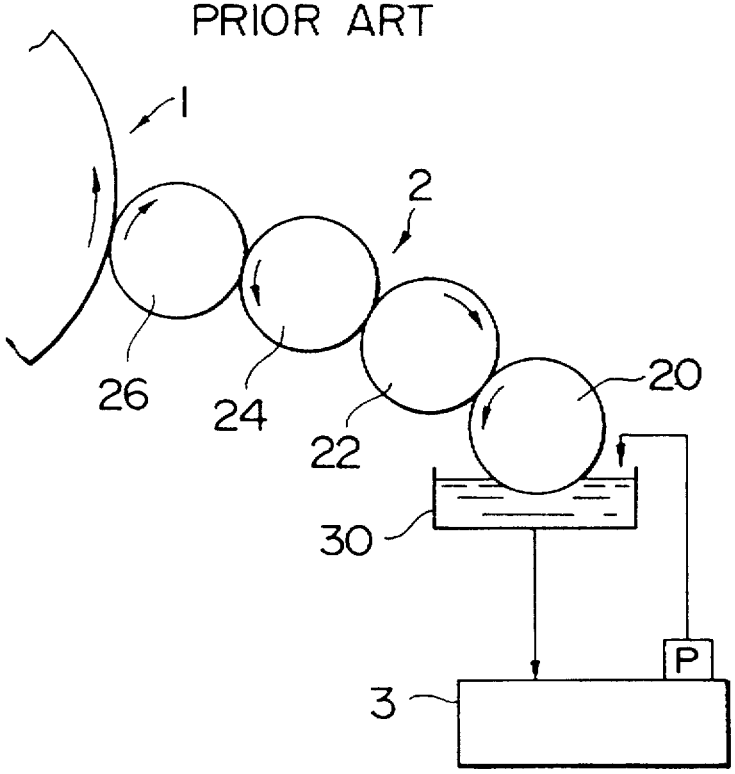
FIG. 23 PRIOR ART
FIG. 23 is a diagrammatic view depicting a conventional dampening water circulation system in a general offset press.

The preferred embodiment of the present invention will now be described with reference to the drawings. FIG. 1 is a diagrammatic view showing a dampening water circulation system in accordance with the present invention. Incidentally, in the description of the following embodiments, the same reference numerals will be used to designate the same or similar components as those in the conventional system shown in FIGS. 23–24, so that the description will be omitted or simplified. In the following descriptions, a water fountain roller should be understood to rake enough water on form plates from a pounded water. Certain terminology will be used in the following description for convenience in reference only and will not be limiting. The words "up", "down", "right" and "left" will designate directions in the drawings to which reference is made. The words "in" and "out" will refer to directions toward and away from, respectively, the geometric center of the device and designated parts thereof. Such terminology will include derivatives and words of similar import.

Figure 2:
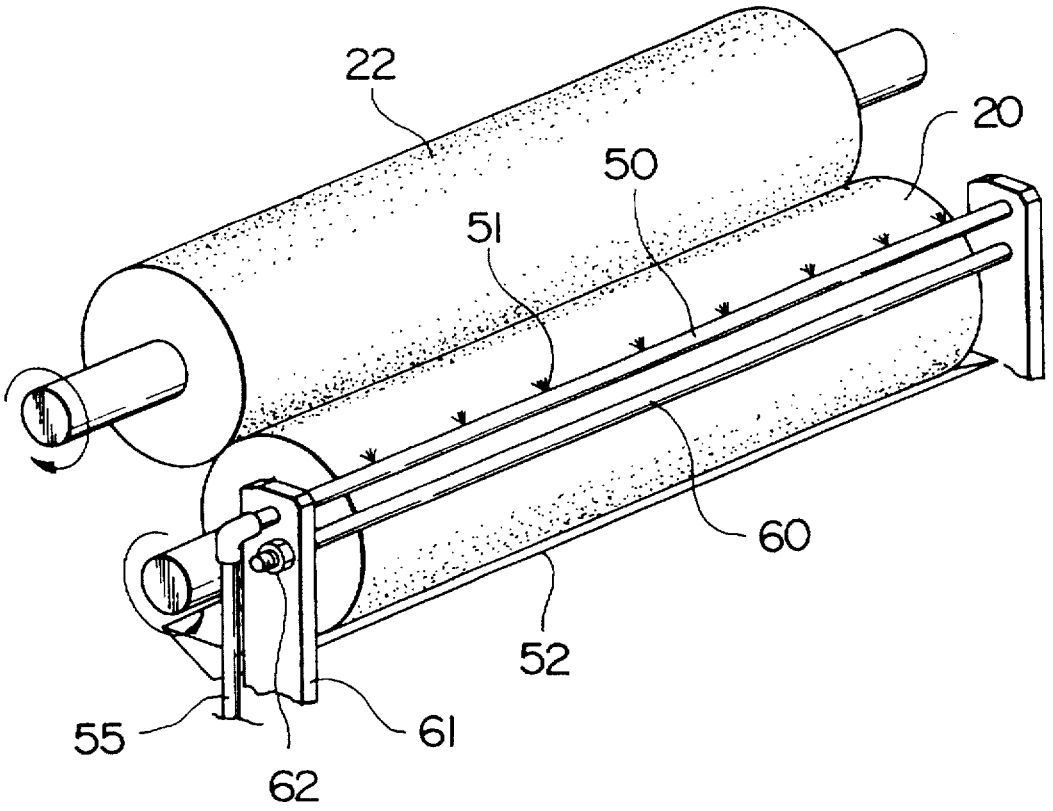
FIG. 2 is a perspective view depicting a main section in the dampening water circulation system.

As can be seen from FIGS. 1 and 2, there is provided a dampening water supply pipe 50 as a dampening water supply member along an central axis of the water fountain roller 20. The dampening water supply pipe 50 is adapted to pour dampening water over the water fountain roller 20 and the poured water can be stored by means of a dampening water pool bar 60 which is supported on a pair of brackets 61 securely attached to side frames of the press in a state parallel to the roller 20.

Figure 3:
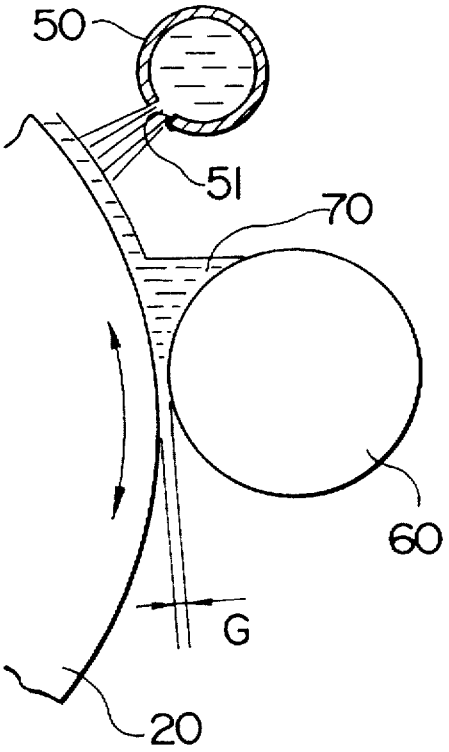
FIG. 3 is an enlarged view depicting a water pool portion.

The dampening water pool bar 60 has a length to slightly pass through the both brackets 61 and is provided at least one end with a tension control means to be stringed between the brackets 61. As shown in FIG. 2, the tension control means of the present embodiment, includes a nut 62 threaded on a male screw portion formed on the end of the pool bar 60 which projects through the brackets 61. When the nut 62 is tightened, tension is exerted on the pool bar 60 being supported between the brackets 61. Such exertion of tension on the pool bar 60 keeps the aperture G, as shown in FIG. 3, constant in width. The stated purpose of the dampening water pool bar 60 is to form a water pool portion 70 along the water fountain roller 20 with an aperture G as shown in FIG. 3. Incidentally, the aperture G should be understood as to be changed depending upon a rotational direction of the water fountain roller 20, but in a case that the roller 20 rotates upwardly it is recommended to be kept by about 0.3 mm.

Figure 4:
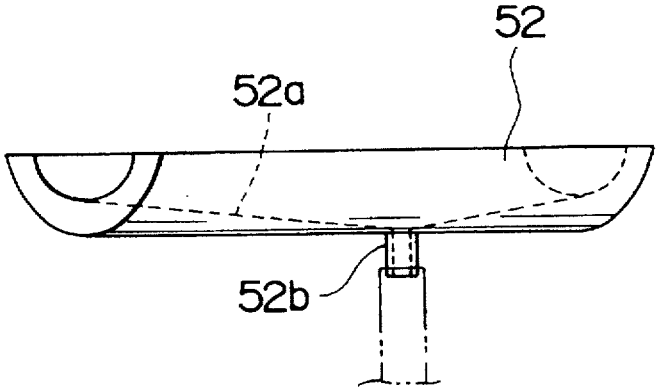
FIG. 4 is a view depicting an example of a drip pan as a return dampening water receiving member.

The water fountain roller 20 is associated with a drip pan 52 thereunder to receive a surplus dampening water which was not transferred to a rubber roller 22 (see, FIG. 1) but dropped therefrom. It is an object for the drip pan 52 to simply gather the dropped dampening water and then return it to a dampening water regulation device 54 in which the water is reprocessed via a return pipe 53. The drip pan 52 has, as shown in FIG. 4, a semi-cylindrical configuration of which inner surface is formed to have a convergent taper 52*a*. The gathered point of the convergent taper 52*a* is opened to be connected with a drain 52*b* adapted to be connected with the return pipe 53.

As can be seen from FIG. 2, the dampening water supply pipe 50 is adapted to feed out certain amount of dampening water uniformly over the water fountain roller 20 from plural water supply holes 51 of which shape, numbers and arrangement can be selected considering necessary amount of dampening water poured over the roller 20. The water supply hole 51 can consists of a simple hole or a slit, otherwise a spray head or a water supply head provided in a peripheral wall of the dampening water supply pipe 50. It should not be limitedly understood that the dampening water should be fed into the dampening water supply pipe 50 via a dampening water supply line 55 from one end or the left side in FIG. 2, but it can be done at both ends or an intermediate portion of the pipe 50. Furthermore, the number of the dampening water supply line 55 can be a single one or plural ones.

The dampening water regulation device 54 is adapted to fulfill its function to regulate and condition water to be used as the dampening water and to filter the returned dampening water.

Figure 5:
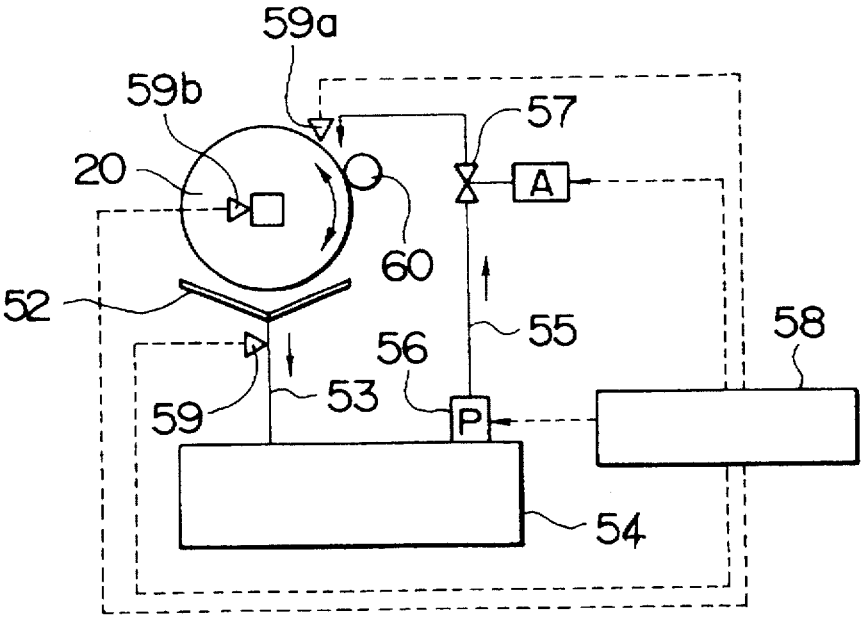
FIG. 5 is a view depicting a system for automatically regulating supply amount of the dampening water.

Now referring to FIG. 5, there is shown a dampening water feed amount control assembly comprises a pump 56 to feed into a dampening water supply line 55 extending therefrom the dampening, water preliminarily regulated and conditioned in the dampening water regulation device 54, a flow regulating valve 57 on the way of the dampening water supply line 55, and a controller 58 to control the pump 56 and the flow regulating valve 57, so that a preferable amount of dampening water is automatically regulated in accordance with a physical quantity indicating a relationship between necessary amount of water and actually fed amount of water.

In order to obtain one physical quantity, there is provided a water amount sensor 59 on the way of the return pipe 53 to detect an amount of water returned to the dampening water regulation device 54. The sensed physical quantity can be utilized to control automatically a running state of the pump 56 or an opening degree of the flow regulating valve 57. The physical quantity may be of a signal issued from a water amount sensor 59*a* disposed at the water pool portion 70 or from a rotational frequency sensor 59*b* at a plate cylinder or the form plate 1 to detect printing speed.

The controller 58 further has a dampening water gain function to responsibly supply an additional dampening water into the water pool portion 70 at the beginning of running or in an irregularly and temporarily happen state of little water in the water pool portion 70 to thereby conduct fine printing. Such responsible supply of an additional dampening water may begin upon a start signal of running, so that a running state of the pump 56 or an opening degree of the flow regulating valve 57 is preferably controlled to supply dampening water additionally in a short period of time.

The responsible supply of an additional dampening water also takes place through running state, when an overflow sensor 59*c* detects no overflow of the dampening water from the water pool portion 70 or when the water amount sensor 59 detects that return water amount from the drip pan 52 does not reach a predetermined value, so that a running state of the pump 56 or an opening degree of the flow regulating valve 57 is preferably controlled to supply dampening water additionally to thereby overcome a water shortage state.

Figure 6:
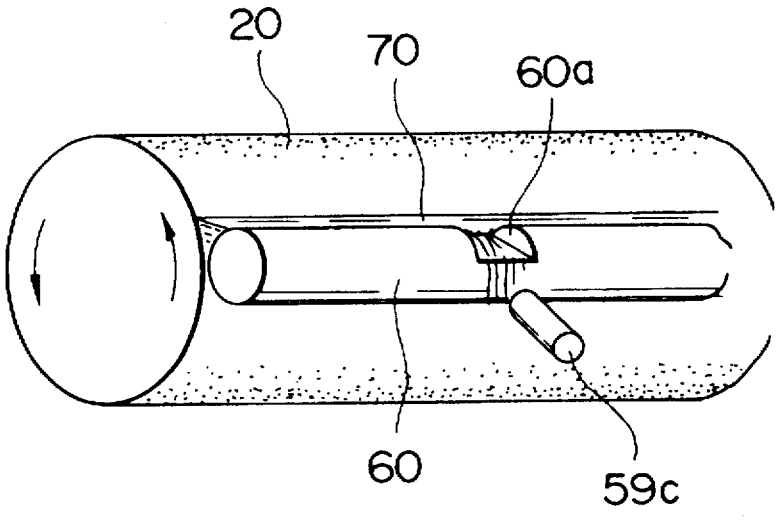
FIG. 6 is a perspective view depicting an embodiment to detect an overflow state at a water pool portion.

Referring to FIG. 6, there is depicted how the overflow sensor 59*c* detects an overflow state of the water pool portion. As can be seen from the drawing, the dampening water pool bar 60 is characterized to have at least one overflow recess 60*a* to constantly allow an overflow of the dampening water from the water pool portion 70. A proximity detector such as the overflow sensor 59*c* is arranged to oppose to the overflow recess 60*a*. It should be understood that only when the water pool portion 70 stores therein enough water, the overflow of the dampening water is constantly taken place via the overflow recess 60*a*. Accordingly, when the overflow sensor 59*c* notes no overflow state, it sends a corresponding signal to the controller 58 to supply the additional supply of dampening water into the water pool portion 70.

It should not be limitedly understood that the additional supply of the dampening water is conducted automatically but it can be controlled manually or done by another method without any controller. Particularly, if a metering pump is utilized without any controller, the additional dampening water is supplied limitedly when the printing speed reaches maximum or if such additional supply is required to be carried out manually, it is enough for a person in charge to regulate the opening degree of the flow regulating valve.

As has been explained above, the supply amount of the dampening water has been considered to be controlled by the opening degree of the flow regulating valve 57 disposed intermediately on the dampening water supply line 55, but it can be replaced with a general solenoid valve controlled by a pulse signal.

Figure 7:
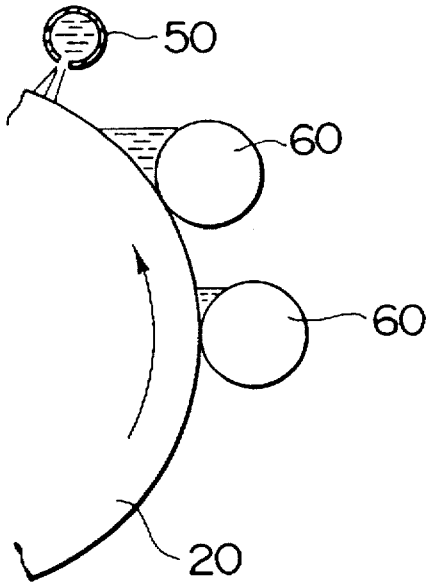
FIG. 7 is a schematical view depicting the water pool portions formed by plural dampening water pool bars.
Figure 8:
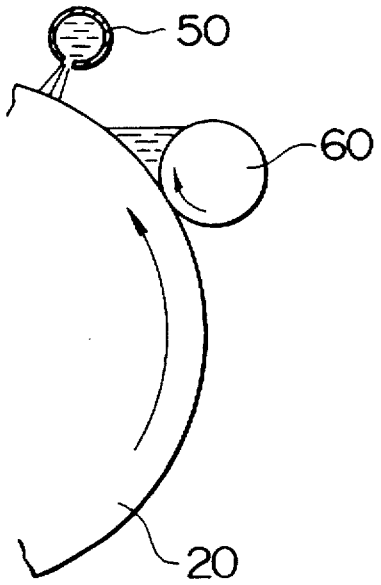
FIG. 8 is a schematical view depicting the water pool portion formed by a rotatable dampening water pool bar.

Now referring to FIG. 7, the dampening water pool bar 60 may consist of several ones (two bars in the drawing) around circumference of the water fountain roller 20. FIG. 8 depicts a state that the bar 60 is adapted to rotate in relation or no relation to the water fountain roller 20 rotating. Incidentally, the rotational direction of the dampening water pool bars 60 is independent from that of the water fountain roller 20. The aperture between the bar 60 and the water fountain roller 20 in FIG. 8 is recommended to be at a range of 0–0.15 mm when respective rotational directions are proper or 0.1–0.3 mm when those are different from one another.

Figure 9:
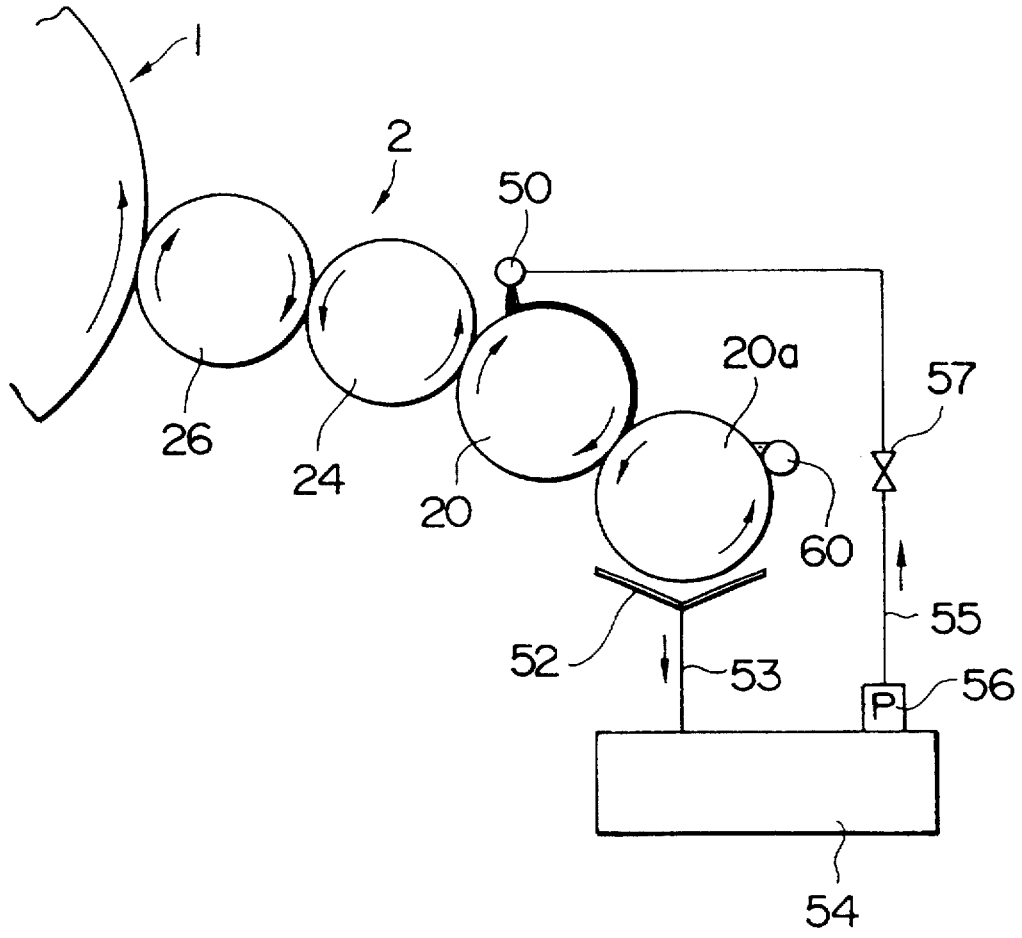
FIG. 9 is a diagrammatic view depicting the water pool portion made on a roller adjacent to the water fountain roller.

The dampening water supply pipe 50 may be disposed near a roller 20*a* adjacent to the water fountain roller 20 as shown in FIG. 9. It should be naturally understood that if the aperture G between the water fountain roller 20 and the bar 60 is properly adjusted as has been explained above, the water fountain roller and other rollers rotate in an opposite direction.

A brief explanation of the operation will be given for convenience.

First of all, necessary amount of dampening water for fine printing is determined and then poured to the water pool portion which serves dampening water to the surface of the water fountain roller entirely. A surplus dampening water which is not transmitted from the water fountain roller to the dampening roller is gathered in the drip pan 52 and then returned to the dampening water regulation device 54.

Figure 10:
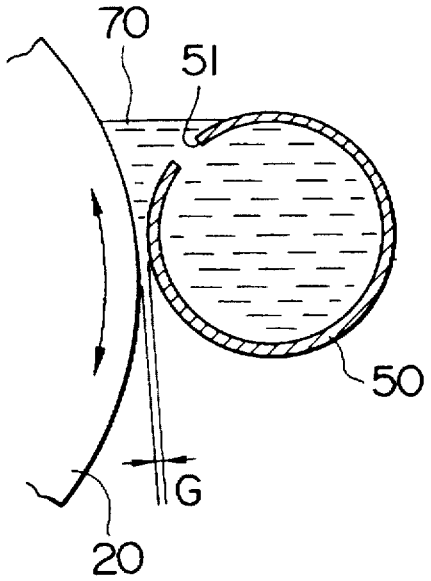
FIG. 10 is a schematical view depicting the water pool portion formed by a dampening water supply pipe which have water supply holes.
Figure 11:
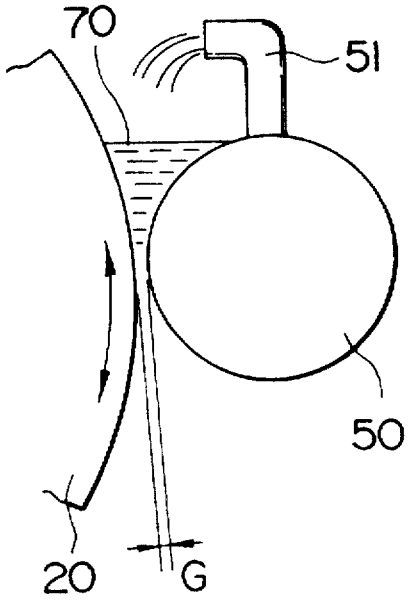
FIG. 11 is a schematical view depicting a water supply head attached on the dampening water supply pipe.

Referring to FIGS. 10 and 11, they depict other embodiments of the water pool portion 70. In these embodiments, the dampening water supply pipe 50 is served as the dampening water supply member so that the water pool portion 70 is formed between them.

The dampening water supply pipe 50 and the water fountain roller 20 are arranged such that an aperture G between them is generally given by 0.3 mm. It should be understood for the water supply holes 51 that if they are enough to provide predetermined amount of the dampening water to the water pool portion 70, the respective configuration thereof are not necessary to be limited. For example, as shown in FIG. 10 each of the holes 51 may have a hole or slit configuration made in the peripheral wall of the dampening water suppler pipe 50 or, as shown in FIG. 11 a water supply head attached on the pipe 50 to serve the water from an upper portion to the water pool portion 70.

Incidentally, the outer configuration of the dampening water supply member is not limited to a cylindrical one but can be other ones.

Figure 12:
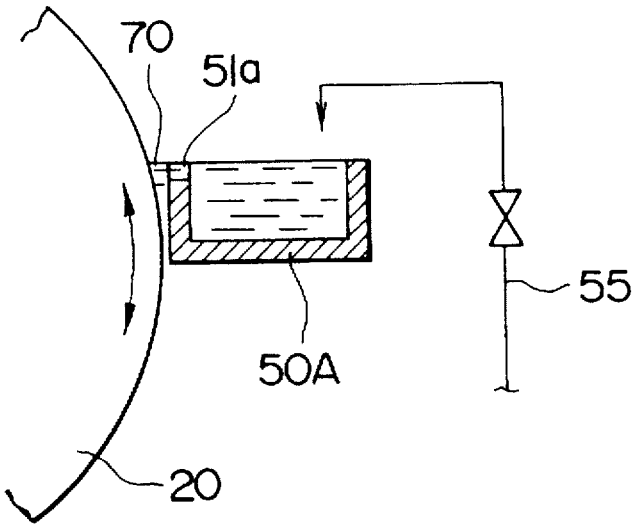
FIG. 12 is a schematical view depicting a water pool portion made by a drainpipe as the dampening water supply member.
Figure 13:
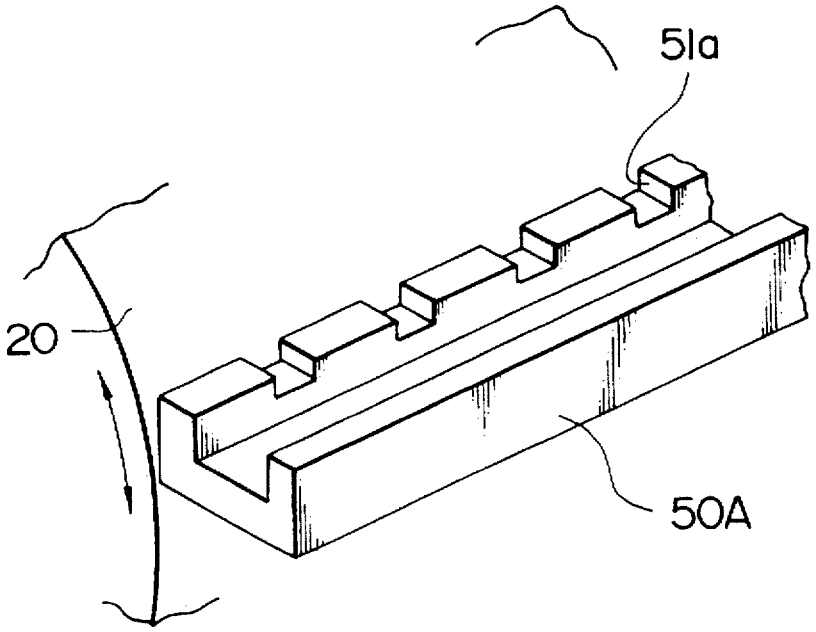
FIG. 13 is a partial perspective view of FIG. 12.

FIG. 12 depicts another dampening water supply member shaped into a sectionally C-shaped drainpipe to form the water pool portion 70. The drainpipe 50A is provided as the dampening water supply member parallel to the water fountain roller 20. As can be recognized from FIG. 13, the water pool portion 70 may be formed between the water fountain roller 20 and the drainpipe 50A which has plural overflow recess 51*a* at every certain intervals on an upper portion of its side wall opposed to the water fountain roller 20. The dampening water is first fed in the drainpipe 50A via a not-shown dampening water supply line and poured to the water pool portion through the overflow recess 51*a*.

Figure 14:
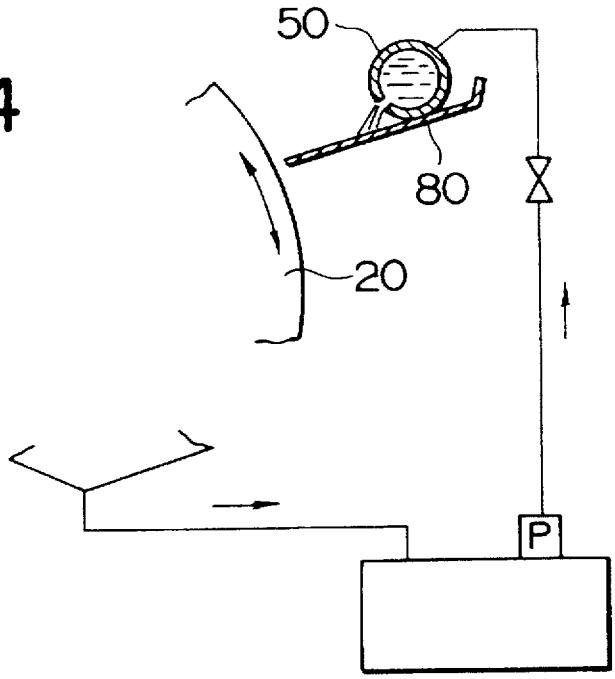
FIG. 14 is a diagrammatic view depicting a dampening water circulation system using a lead plate.

Referring to FIG. 14, there is shown another embodiment which is characterized to have an additional lead plate 80 parallel to the water fountain roller 20 to guide the dampening water toward the surface of the water fountain roller 20.

Figure 15:
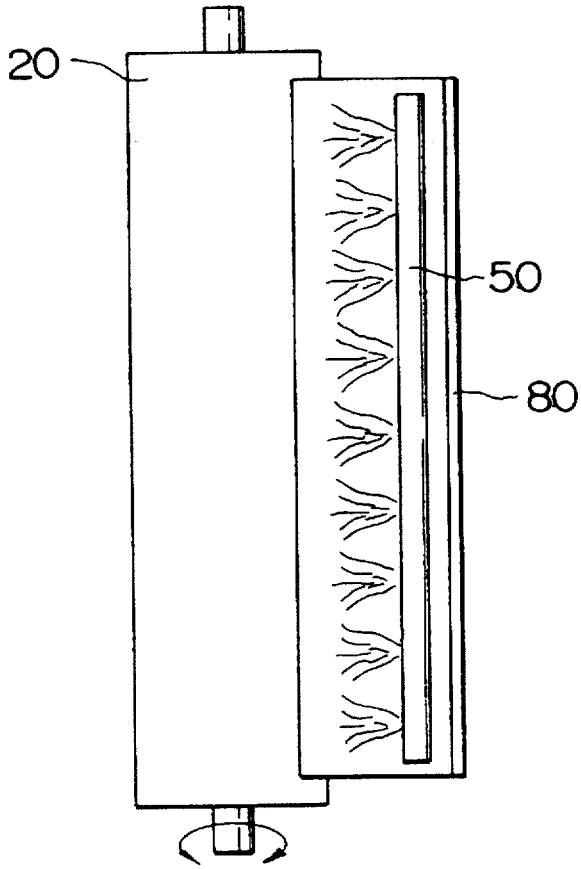
FIG. 15 is a top view of FIG. 14 depicting an arrangement of a lead plate, a water supply pipe and the water fountain roller.

The lead plate 80 consists of a vertical section behind the pipe 50 and a tilted section extending from lower end of the vertical section and is adjusted in vertical direction under the dampening water supply pipe 50. The dampening water supplied from the dampening water supply pipe 50 on the lead plate 80 is spread until served on the water fountain roller 20 while flowing down as shown in FIG. 15. This is convenient to minimize amount of dampening water uniformly applied on the water fountain roller 20.

Figure 16:
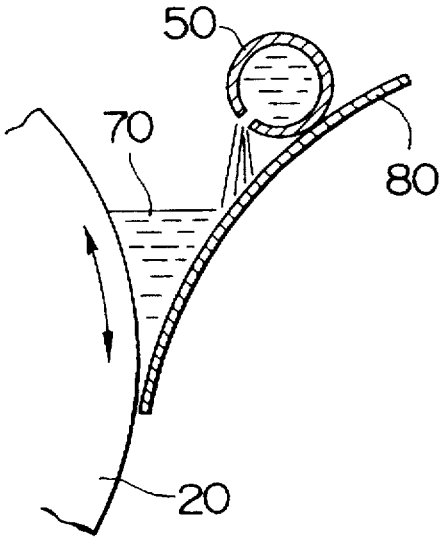
FIG. 16 is a schematical view depicting the water pool portion formed by an elastic lead plate.

FIG. 16 is another embodiment of the lead plate made of an elastic materials. The lead plate 80 is generally a metal plate made of spring steel or a plastic plate, and of which forward end portion is always kept contacting with the surface of the water fountain roller 20 by harnessing a righting moment of the lead plate. Accordingly, the water pool portion 70 is formed between the lead plate and the water fountain roller. The dampening water fed from the dampening water supply pipe 50 is stored in the water pool portion 70 guided by the lead plate 80 to thereby applied on the water fountain roller. In this arrangement, the rotational direction of the water fountain roller 20 shown in the drawing is limited in the same direction as the tilted direction of the lead plate 80 not to catch the plate 80 under the roller 20.

Figure 17:
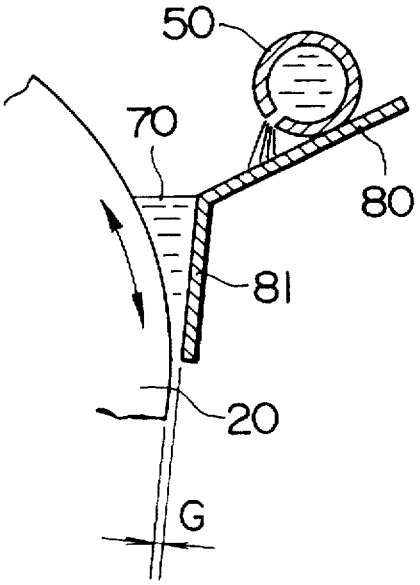
FIG. 17 is a schematical view depicting the water pool portion formed by a lead plate.

FIG. 17 depicts another embodiment of the lead plate. The shown lead plate 80 is located under the dampening water supply pipe 50 and is associated with a flap portion 81 which gradually closes to the water fountain roller 20 to form the water pool portion 70 between the flap portion and the water fountain roller.

The dampening water supplied from the pipe 50 is spread on the lead plate 80 while flowing down and then stored in the water pool portion 70. It should be understood that an object and operation of this lead plate 80 are the same as previously explained lead plates.

Figure 18:
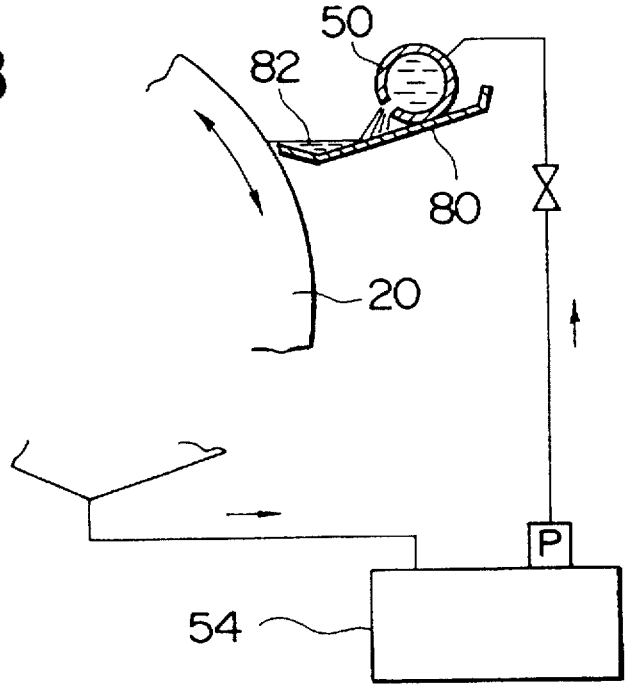
FIG. 18 is a schematical view depicting a lead plate in which the water pool portion is formed.

FIG. 18 also shows another embodiment of the lead plate in accordance with the present invention. The lead plate 80 is characteristically bent at its forward portion upwardly to form the water pool portion 82.

Figure 19:
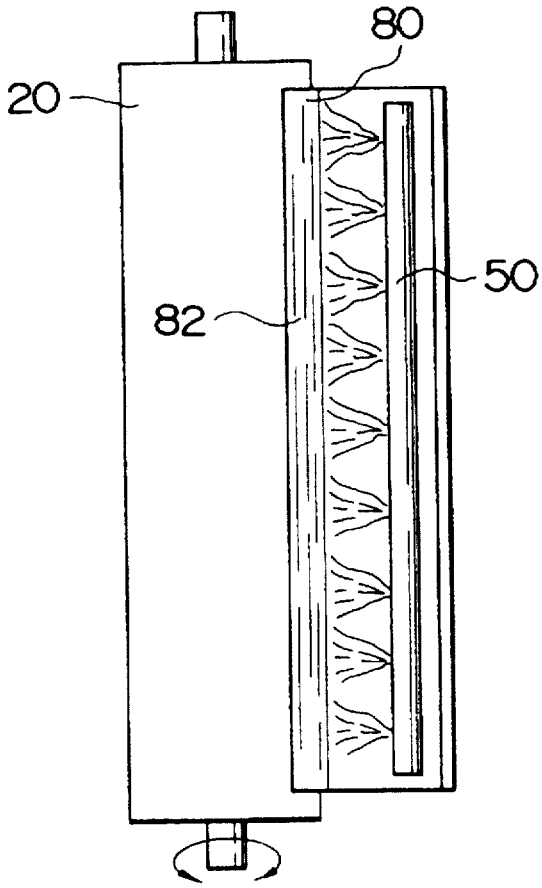
FIG. 19 is a top view of FIG. 18 depicting an arrangement of a lead plate, a water supply pipe and the water fountain roller.

The dampening water supplied from the dampening water supply pipe 50 is as shown in FIG. 19 spread on a slightly tilted surface of the lead plate 80 while flowing down, once stored in the water pool portion 82 and finally applied entirely on the water fountain roller 20.

Figure 20:
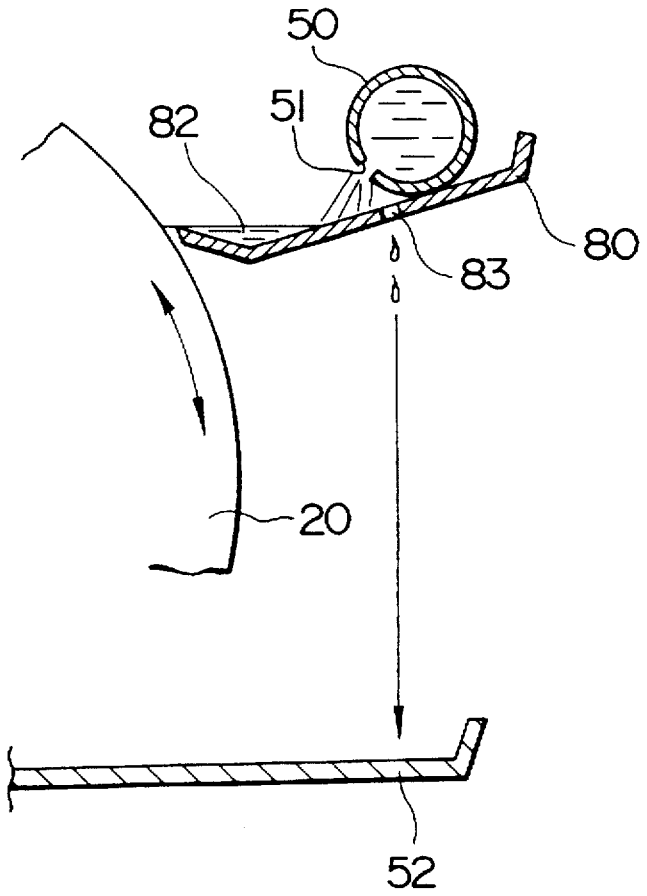

When the dampening water supply pipe 50 is securely attached on the lead plate 80, it is recommended to provide a relief hole 83 as shown in FIG. 20 near the dampening water supply pipe 50 and upper side than a vertical axis aligned with the water supply hole 51 so that unexpected overflow dampening water can be released through the hole 51 to the drip pan 52.

Figure 21:
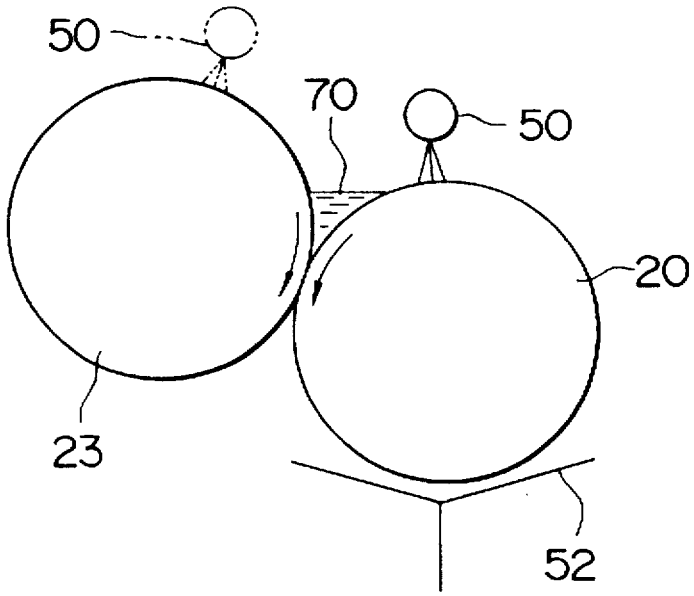
FIG. 21 is a schematical view depicting the water pool portion formed between the water fountain roller and an adjacent roller.
Figure 22:
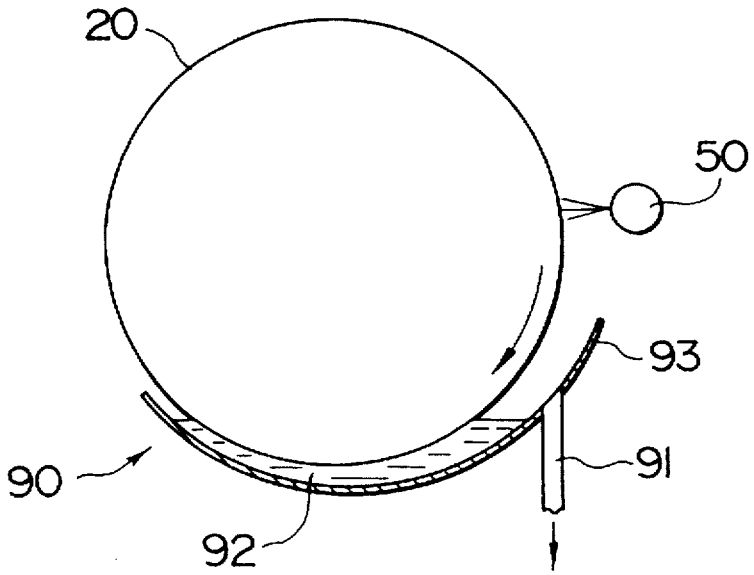
FIG. 22 is a schematical view depicting the water pool portion formed in a drip pan utilized as a lead plate.

FIG. 21 depicts another embodiment in accordance with the present invention and, more particularly a state that stagnant water is constantly maintained between the water fountain roller 20 and an adjacent roller 23. The adjacent roller 23 is arranged to contact with or close to the water fountain roller 20 to keep the dampening water fed from the dampening water supply pipe 50 between them. Incidentally, overflow dampening water from the water pool portion 70 can be naturally received by a not-shown drip pan as other embodiments explained above.

When the water fountain roller 20 and the adjacent roller 23 rotate in an arrow direction as shown in FIG. 21, the dampening water supplied from the dampening water supply pipe 50 which is selectively provided either near the roller 20 or the roller 23 is kept in the water pool portion 70 to be transmitted by a proper quantity thereof toward the adjacent roller 23.

Figure 24:
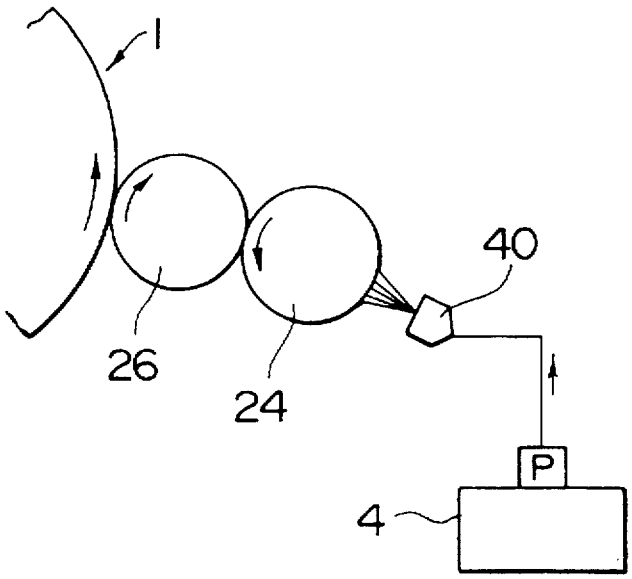
FIG. 24 PRIOR ART
FIG. 24 is a diagrammatic view depicting a spray-type conventional dampening water circulation system in a general offset press.

Now referring to FIG. 24, it should be understood that the drip pan is utilized as the lead plate. The drip pan 90 is disposed under the water fountain roller 20 and formed to have a similar shape to the water fountain roller entirely and to partially close to the lower surface of the roller 20 so as to obtain an area to keep the dampening water. The drip pan 90 is arranged under the water fountain roller 20 to obtain a water pool portion 92 near the lower portion of the roller 20 and a lead plate 93 extending in a direction oppose to the rotational direction of the water fountain roller 20. There is provided the dampening water supply pipe 50 above the lead plate 93 as can be seen from the drawing. The drip pan 90 is also provided with a drain 91 at an upper portion than the water pool portion 92 to release overflow dampening water through a return pipe 91.

In this embodiment, the dampening water fed out from the dampening water supply pipe 50 is once poured on the lead plate 93 before the water pool portion 92 and then contacts with the lower portion of the water fountain roller 20. Accordingly, it can be said that the arrangement planning of the rollers can be done freely within a rather small area. This type water pool portion seems to be merited to obtain a complete application of the dampening water to the water fountain roller compared with that by the above mentioned type lead plate with no water pool portion. However, it should not be limitedly considered that the water pool portion is formed by bending the forward portion of the lead plate, but it is enough to be a structure to terminate the dampening water along the surface of the water fountain roller before application.

The following effects are expected to be obtained in accordance with the present invention.

(1) As the water fountain roller is isolated from the dampening water which is received in the drip pan and thereafter will be returned to the dampening water regulation device, it does not cause an increase of temperature of the return dampening water because of heat generated in the press. Accordingly, it will be no longer necessary to have large cooling capacity for the return water.

(2) The minimum drip pan in size is preferable in view of preventing heat leakage and inclusion of ink and link. As the dampening water is adapted to be supplied as the spray method, the present invention can be applied to a dampening water supply member like a dampening water supply nozzle which is not required to apply the water to the roller in a strict manner.

(3) The minimum drip pan in size is also effective to shade the dampening water stored therein from an atmosphere heat since the water does not stay long therein, so that the dampening water regulation device is not necessary to have much capacity, that is made small in size, to cool the return dampening water.

As has been mentioned above, in accordance with the present invention, it is enough to supply small quantity of dampening water toward form plates for fine printing, so that the dampening water regulation device is not required to have large capacity to cool and filter the dampening water. Furthermore, a maintenance for the dampening water supply member and other devices can be simplified. Accordingly, further lightweighting and reduced cost will be achieved.

What is claimed is:

1. A dampening fluid circulation system for use in a printing press, comprising:

(a) a form plate rotatably affixed to the press;

(b) a dampening fluid reservoir;

(c) a dampening fluid fountain roller aligned parallel to said form plate;

(d) a dampening fluid supply member in fluid communication with said dampening fluid reservoir and positioned adjacent to said fountain roller, said supply member having an orifice directed towards said fountain roller so that a dampening fluid traveling through said fluid supply member exits said orifice, a portion of said dampening fluid adhering to said fountain roller;

(e) at least one other roller aligned parallel to said form plate, said other roller interposed between said form plate and said fountain roller, and in serial contact with said form plate and said fountain roller so that said dampening fluid may be transmitted from said fountain roller, to said other roller, and to said form plate;

(f) a dampening fluid pool member comprising a substantially hollow bar, said dampening fluid pool member aligned parallel and adjacent to said fountain roller and creating a dampening fluid retaining gap disposed between said fountain roller and said pool member; and (g) a dampening fluid collector positioned below said fountain roller and said other roller whereby said collector collects a portion of dampening fluid falling from said other roller and said fountain roller, said collector being in fluid communication with said dampening fluid reservoir.

2. The device of claim 1 wherein said bar is stationary.

3. The device of claim 1 wherein said supply member comprises said pool member.

4. In a printing press having a form plate and a dampening fluid reservoir, a dampening fluid circulation system comprising:

(a) at least one roller means parallel to said form plate and in serial contact with one another and said form plate for transporting said dampening fluid to said form plate;

(b) a dampening fluid supply means in fluid communication with said fluid reservoir for supplying an amount of a dampening fluid to said roller means;

(c) a cylindrical dampening fluid pool means affixed to said press adjacent to a one of said roller means for retaining a portion of said dampening fluid between said pool means and said one of said roller means;

(d) a dampening fluid collector means positioned below said roller means in fluid communication with said reservoir for collecting an excess of said dampening fluid that was not transported to said form plate; and (e) said cylindrical dampening fluid pool means is a dampening fluid supply pipe.

5. The device of claim 4 wherein said supply means comprises a dampening fluid supply control means for regulating the amount of said dampening fluid supplied to said roller means.

6. The device of claim 5 wherein said dampening fluid is supplied to said roller means at a given rate and said control means comprises a sensor means affixed to said press for detecting a rate of collection of dampening fluid by said collector means, said control means regulating the rate of dampening fluid supplied to said roller means to be inversely proportional to said rate of collection.

7. The device of claim 6 wherein said pool means has an overflow means for limiting the amount of dampening fluid retained by said pool means.

8. The device of claim 5 wherein said control means comprises a sensor means for detecting an amount of dampening fluid retained by said pool means, said control means regulating the amount of dampening fluid supplied to said roller means to be inversely proportional to said amount retained by said pool means.

9. The device of claim 5 wherein said control means comprises a rotational frequency sensor means affixed to said press for detecting the rotational frequency of said form plate, said control means regulating the amount of dampening fluid supplied to said roller means to be proportional to said rotational frequency.

10. The device of claim 7 wherein said pool means comprises said supply means.

* * * * *